US009959695B2

(12) United States Patent
Sprenger

(10) Patent No.: US 9,959,695 B2
(45) Date of Patent: May 1, 2018

(54) COIN BOX FOR A COIN-OPERATED DEVICE

(71) Applicant: NOVOMATIC AG, Gumpoldskirchen (AT)

(72) Inventor: Tobias Sprenger, Bingen (DE)

(73) Assignee: NOVOMATIC AG, Gumpoldskirchen (AT)

( * ) Notice: Subject to any disclaimer, the term of this patent is extended or adjusted under 35 U.S.C. 154(b) by 63 days.

(21) Appl. No.: 14/652,315

(22) PCT Filed: Nov. 12, 2013

(86) PCT No.: PCT/EP2013/073544
§ 371 (c)(1),
(2) Date: Jun. 15, 2015

(87) PCT Pub. No.: WO2014/090496
PCT Pub. Date: Jun. 19, 2014

(65) Prior Publication Data

US 2015/0325074 A1 Nov. 12, 2015

(30) Foreign Application Priority Data

Dec. 14, 2012 (DE) ..... 10 2012 112 344

(51) Int. Cl.
*G07F 9/06* (2006.01)

(52) U.S. Cl.
CPC ..... *G07F 9/06* (2013.01)

(58) Field of Classification Search
CPC ..... G07F 9/06; G07F 17/32; G07D 11/0009; G07D 1/02; E05G 1/026
USPC ..... 232/1 D, 15, 16, 43.5, 44; 194/350; 206/0.8, 0.81, 0.815; 453/18; 109/73
See application file for complete search history.

(56) References Cited

U.S. PATENT DOCUMENTS

| | | | | |
|---|---|---|---|---|
| 3,268,158 A | | 8/1966 | Abbott | |
| 3,836,069 A | | 9/1974 | Craig, Jr. | |
| 4,371,071 A | * | 2/1983 | Abedor | G07F 1/043 194/212 |
| 5,873,446 A | * | 2/1999 | Wei | G07F 9/06 194/350 |
| 5,907,141 A | * | 5/1999 | Deaville | G07F 9/06 194/207 |
| 6,014,594 A | * | 1/2000 | Heidel | G07D 11/0006 109/23 |

(Continued)

FOREIGN PATENT DOCUMENTS

| | | |
|---|---|---|
| CN | 202227945 | 5/2012 |
| DE | 4003702 | 8/1991 |

(Continued)

OTHER PUBLICATIONS

ISR for PCT/EP2013/073544, English translation attached to original, Both completed by the European Patent Office dated Feb. 25, 2015, 7 Pages.

*Primary Examiner* — William L Miller
(74) *Attorney, Agent, or Firm* — Brooks Kushman P.C.

(57) ABSTRACT

A coin box for a coin-operated device, the box having a housing, the front face of which is provided with a removal opening. A sliding door is associated with the removal opening and a supporting floor for the coins is situated in the interior of the housing. The supporting floor runs at an incline from a rear wall of the housing towards the removal opening.

15 Claims, 5 Drawing Sheets

(56) References Cited

U.S. PATENT DOCUMENTS

Figure 1:
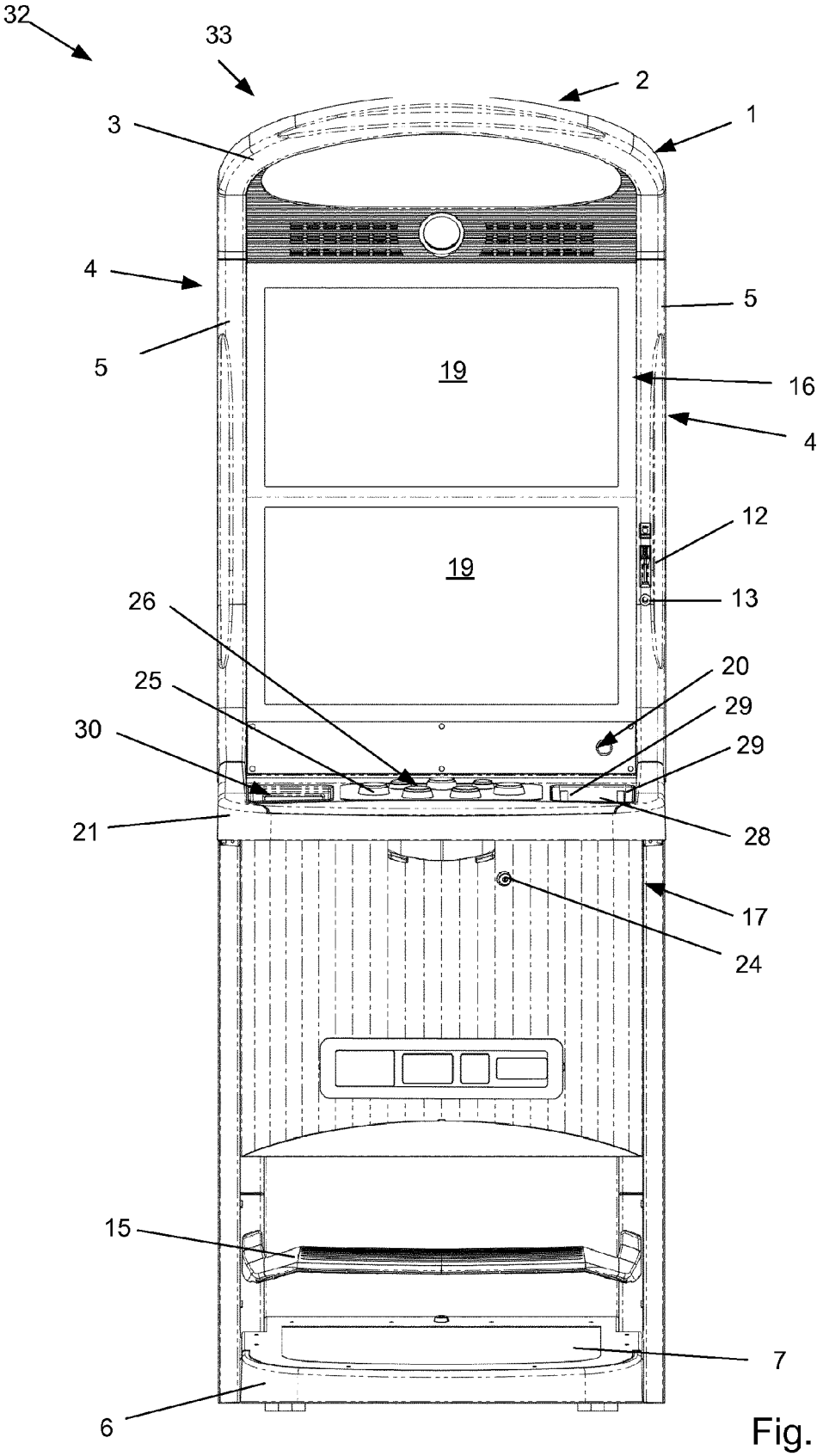

| | | | | |
|---|---|---|---|---|
| 6,165,064 | A * | 12/2000 | Aurelius | G07F 9/06 453/18 |
| 6,264,545 | B1 | 7/2001 | Magee et al. | |
| 2001/0015310 | A1* | 8/2001 | Cole | G07D 9/00 194/229 |
| 2004/0055902 | A1 | 3/2004 | Peklo | |
| 2008/0017473 | A1* | 1/2008 | Nunn | G07F 9/06 194/350 |
| 2015/0317858 | A1* | 11/2015 | Suetaka | G07D 13/00 194/351 |
| 2015/0325074 | A1* | 11/2015 | Sprenger | G07F 9/06 232/44 |

FOREIGN PATENT DOCUMENTS

| | | |
|---|---|---|
| EP | 0326051 | 8/1989 |
| EP | 0924660 | 6/1999 |
| EP | 2407940 | 1/2012 |
| GB | 503243 | 4/1939 |
| GB | 2320604 | 6/1998 |
| TW | 421560 | 1/2012 |
| WO | 2005090731 | 9/2005 |

* cited by examiner

COIN BOX FOR A COIN-OPERATED DEVICE

CROSS-REFERENCE TO RELATED APPLICATION

This application is the U.S. national phase of PCT Application No. PCT/EP2013/073544 filed on Nov. 12, 2013, which claims priority to DE Patent Application No. 10 2012 112 344.6 filed on Dec. 14, 2012, the disclosures of which are incorporated in their entirety by reference herein.

The invention relates to a coin box for a coin-operated device, wherein the coin box has a housing with a front-side removal opening, and to a gaming machine with a device housing in which a coin box is accommodated.

Devices with coin boxes which are generally fixed installed in the device or are an integral part of the device are known in practice. The coin boxes are frequently formed by a cavity configured in the shape of a rectangular parallelepiped. Overall, the emptying of the coin boxes proves to be complicated since the money has to be conveyed by hand out of the coin box into a collecting container arranged in front of a removal opening of the coin box, wherein the collecting container is generally designed as a money bag which is held by hand in front of the removal opening. The removal opening is closable by a pivotably arranged door or flap. The simultaneous opening of the door and/or flap and the removal of the coin money and the holding of the collecting container can be difficult to bring about, in particular since coins emerge from the coin box as soon as the door or flap is opened, but said coin box is not completely emptied.

WO 2005/090 731 A1 and U.S. Pat. No. 3,836,069 A1 both disclose a coin box which comprises a housing with a front-side removal opening. The removal opening is assigned a door which is mounted in a laterally pivotable manner on a front side of the housing. A plurality of supporting floors for the coins are arranged in the interior of the housing, wherein the supporting floors are inclined from opposite side walls of the housing in the direction of the center of the housing. The removal opening is formed in the center of the housing of the coin box in the front side thereof.

The invention is based on the object of providing a coin box and a gaming machine of the type mentioned at the beginning, which coin box and gaming machine are configured to be service-friendly and therefore so as to be simple to handle.

According to the invention, the object is achieved by the features of the independent claims.

The dependent claims constitute advantageous refinements of the invention.

In the case of a coin box for a coin-operated device, the coin box comprises a housing with a front-side removal opening, wherein the removal opening is assigned a sliding door, and a supporting floor for the coins is arranged in the interior of the housing, wherein the supporting floor is inclined from a rear wall of the housing in the direction of the removal opening.

Within the context of the invention, a coin should be understood as meaning not only a corresponding money item, but equally also tokens or other token coins, chips or the like. Accordingly, the coin box is also not solely intended for receiving money items, but can also be filled with tokens, chips or other token coins which, for example, are present in an unordered pile.

Of course, the coin box can also be arranged in any desired device which is to be actuated by money, token coins or the like. This should be understood as meaning, in particular, money-operated gaming machines, vending machines or other payment devices in which coins are collected, for example passage barriers which permit passage after a payment operation.

Furthermore, the configuration of the coin box in the manner of a safe is not ruled out, but this stable design is less important if the coin box is protected against unauthorized entry or access in a corresponding housing or the device accommodating the coin box is, for example, under observation by supervisory staff.

The supporting floor of the coin box according to the invention can be arranged as an intermediate floor in the interior of the housing. By means of the slope formed by the oblique plane of the supporting floor, the coins present in the coin box slide outward through the removal opening when the sliding door is opened. Accordingly, it is not necessary for the service staff emptying the coin box to clear the coin box using hands, and instead the coins pass because of the weight thereof into the open via the oblique plane of the supporting floor which is inclined from the rear wall in the direction of the front side of the housing. Furthermore, the sliding door can be opened simply and continuously and, unlike a pivotably coupled door or flap, does not spring open after unlocking due to the pressure, which acts from the inside, of the coins present in the coin box. The sliding door thus also facilitates the servicing of the coin box, i.e. in particular the emptying thereof.

In order to protect the coin money in the coin box from unauthorized access, the sliding door, for locking in the position thereof closing the removal opening, is expediently assigned a lock to be actuated with a key.

In a development, the housing is manufactured from a steel plate and is configured in the shape of a rectangular parallelepiped, wherein the removal opening is formed on a front side of the housing in the floor region thereof and preferably has a front panel which is arranged above the removal opening and has a plurality of spaced-apart holes which are arranged next to one another and/or above one another. If the front panel is provided with the holes which, in particular, have a smaller clear width than the smallest coin to be collected in the coin box, the service staff can immediately identify the filling level of the coins in the coin box and can decide whether their emptying is or is not required. The holes do not inevitably have to be of round design; slot-shaped openings or apertures in the form of a polygon, for example a square, pentagon or hexagon, can also be provided. Furthermore, there is the possibility of backing the holes with a transparent component in order to prevent the coins from emerging from the coin box. The steel plate itself can have a strength making it difficult to forcibly break open the coin box.

The sliding door is preferably mounted in the region of opposite side walls of the housing, wherein the upper and lower end position of said sliding door are delimited by respective stops. After the stops are fitted, the sliding door is held captively on the housing.

In order to guide the sliding door, a bent portion in each case extending parallel to and at a distance from the associated side wall is preferably formed on both sides, wherein the sliding door has, on both sides, a multiply bent flange which engages around the bent portion and extends into a clearance present between the bent portion and the side wall. In order to configure the guide means on the sliding door and the housing, additional guide elements do not necessarily have to be arranged. The guide means on both sides can be formed integrally with the sliding door or the housing by corresponding deformations. Furthermore, the bent portions are configured in such a manner that they provide as small an engagement surface as possible for a tool in order to make it difficult to break open the coin box. Furthermore, the flanges on the longitudinal sides effect a stabilization of the sliding door over the height thereof, the stabilization preventing a deflection.

In order to stabilize the sliding door over the width thereof by means of a corresponding shaping, the sliding door advantageously has, on the upper side, a handle piece which is formed, preferably by deformation, on an upper edge, and the free lower edge of said sliding door has a double-layered reverse bend.

Expediently, the housing comprises a base which leads on the front side into a foot panel which forms a lower edge of the removal opening and is arranged parallel to the front panel and so as to be able to be overlapped by the sliding door in the closed state, wherein the supporting floor which extends toward the rear wall in the direction of a cover and runs over the entire width of the housing emerges from the foot panel and is preferably held on a tab assigned to the rear wall. The foot panel and the front panel are located in one plane and the sliding door is displaced in said plane in order to open up or to close the removal opening. The base can have elements which interact with guides and/or fastenings in the housing in order to position the coin box, optionally removably, in a defined position or to fix same in the housing. The supporting floor which is arranged as an intermediate floor in the housing is held substantially between the foot panel and the tab.

In a refinement, the lock is arranged in a side wall of the housing, and a locking bolt which is assigned to the lock extends through the foot panel and lies in a recess of the sliding door in order to lock the latter in the position closing the removal opening. The locking bolt is completely arranged within the housing and is not accessible from the outside. Said locking bolt projects into the open only with the free end side thereof which faces away from the lock, and protrudes slightly over the outer front side of the sliding door.

Expediently, a filling opening and a clearance extending to the front side of the housing are formed in the cover, wherein the clearance is dimensioned for a hand to reach therethrough and is part of an integral handle piece. The handle piece facilitates the handling of the coin box during the removal thereof from the device. The filling opening serves for filling the coin box with coins and can be connected to a coin channel, for example of a coin acceptor unit. Furthermore, it is possible to secure the filling opening from the inside in such a manner that the coins cannot pass into the open, for example by means of a spring-loaded closure device and/or a labyrinth.

So that the service staff can use hands when emptying the coin box, for example, for opening the sliding door, holders are provided for a money bag. The money bag can be fastened to the housing before the sliding door is opened, in order subsequently to open the sliding door so that the money slips out of the coin box via the supporting floor into the money bag.

The gaming machine comprises a device housing in which a previously explained coin box is accommodated.

The gaming machine which is frequently operated with coin money is equipped with the coin box which is easy for the service staff to empty and is installed fixedly or removably in the device housing. In the case of a removable coin box, the latter can be accommodated in the gaming machine by guide elements on the device-housing side. Furthermore, the service staff can replace a coin box to be emptied by an empty coin box such that the gaming machine can be operated again after a very short period of time. The coin box to be emptied can be emptied in a service or cashier's room, away from the public, and the coins can be supplied for further processing, for example to a counting and/or sorting device.

Expediently, the coin box is arranged downstream of a coin acceptor unit which is connected via a coin channel to a housing-side coin insertion slot which is preferably assigned to a frame of the device housing.

So that the coin box can be reached in a straightforward manner for the service staff, the device housing is preferably closable on the front side thereof with at least one upper and/or lower front flap, preferably with an upper and a lower front flap which are arranged so as to be pivotable in an opposed manner on the device housing. After the device housing is opened by pivoting the front flaps, the interior of the gaming machine is freely accessible and the service staff can easily reach the corresponding components, in particular the coin box.

In a further preferred refinement, the upper front flap has at least one display device, preferably a screen, for depicting a game sequence, and/or the lower front flap has a console with operating elements for controlling a game sequence, wherein the display device, the operating elements and/or a money processing device are connected to a game sequence controller.

It goes without saying that the features mentioned above and those which have yet to be explained below can be used not only in the respectively stated combination, but also in different combinations. The scope of the invention is defined only by the claims.

Figure 2:
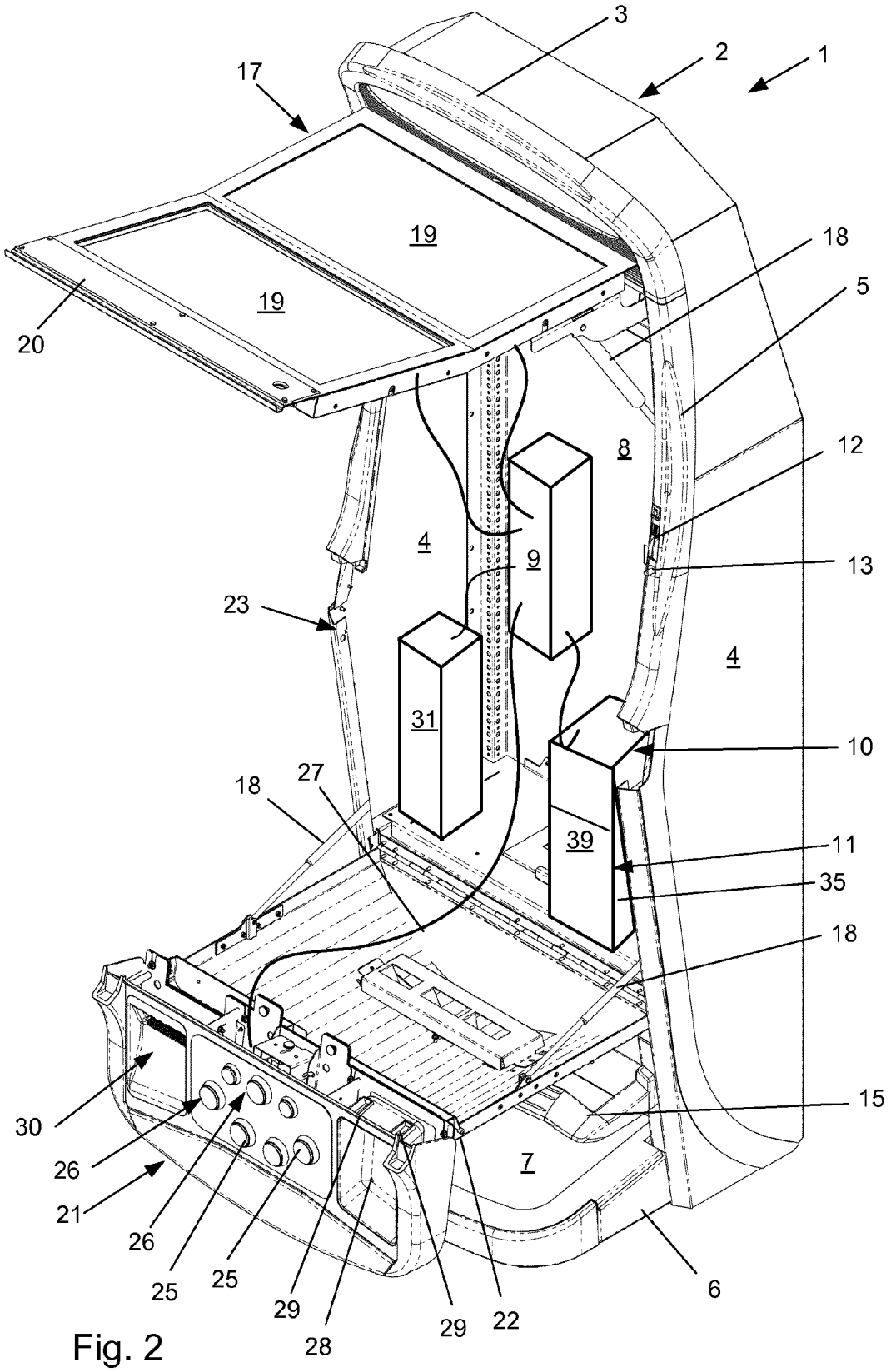
Figure 3:
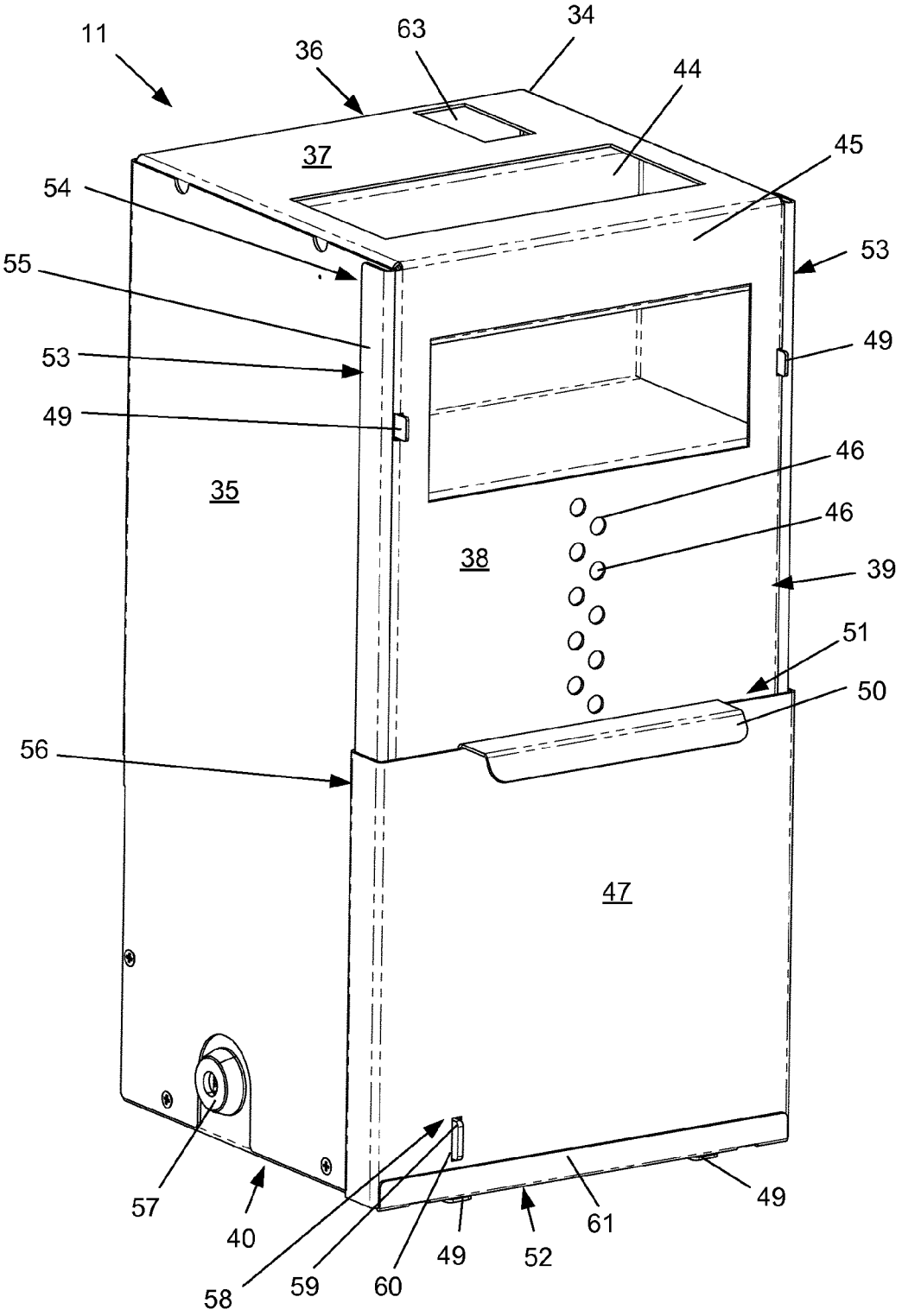
Figure 4:
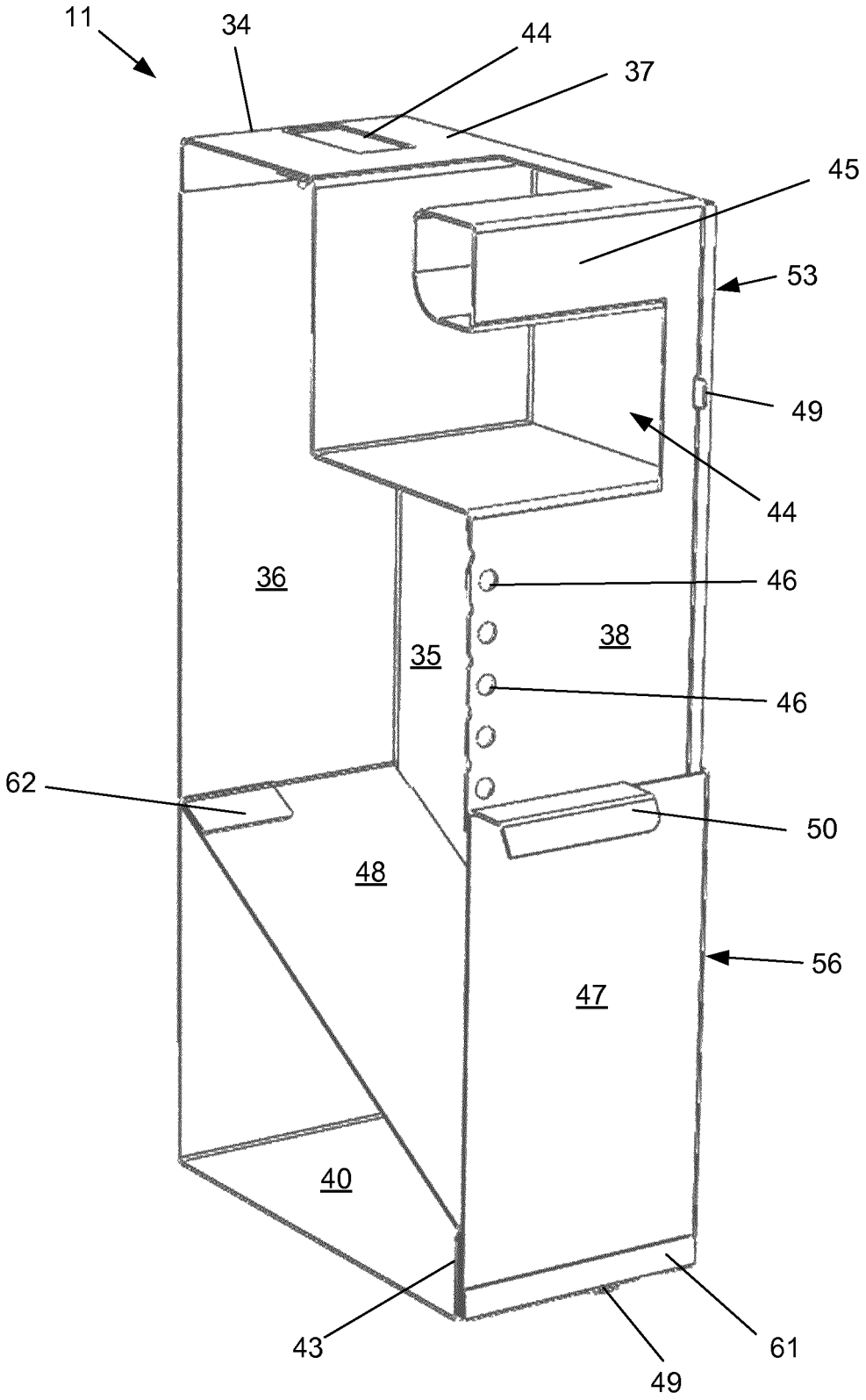
Figure 5:
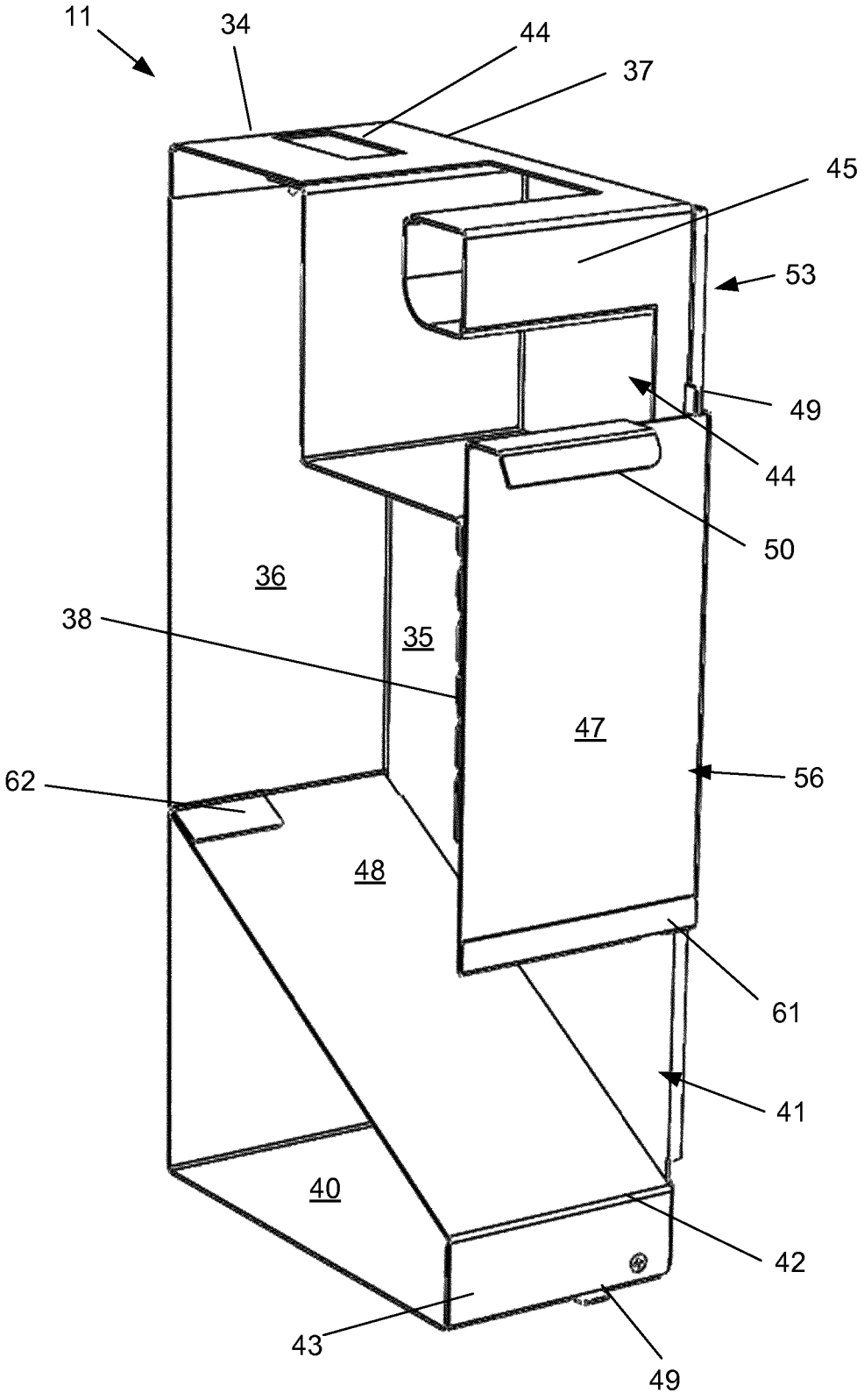

The invention is explained in more detail below using exemplary embodiments with reference to the associated drawing, in which:

FIG. 1 shows a front view of a gaming machine with a coin box according to the invention, FIG. 2 shows a perspective illustration of the gaming machine according to FIG. 1 with front flaps open, FIG. 3 shows a perspective illustration of the coin box with a closed removal opening, FIG. 4 shows a sectional illustration of the coin box according to FIG. 3 with the closed removal opening, and FIG. 5 shows a sectional illustration of the coin box according to FIG. 3 with the removal opening open.

The gaming machine 32 comprises a device housing 33 which is designed as a vertical housing 1 and has an upper-side head part 2 with a curved frame part 3, two opposite side walls 4, to which frames 5 are assigned on the end sides, a standing base 6 with a cover panel 7 which can be backlit, and, of course, a rear wall 8. A game sequence controller 9 which is coupled to a money processing unit 10 is accommodated in the vertical housing 1, wherein the money processing unit comprises a coin acceptor unit (not illustrated specifically), a coin box 11 and coin payout unit. The coin acceptor unit is connected via a coin shaft, which is accommodated behind the associated frame 5, to a coin insertion slot 12 installed in the frame 5. A return button 13 is located in the frame 5 below the coin insertion slot 12. A foot rest 15 which is configured in the form of a bar and extends over the entire width of the front of the vertical housing 1 is provided between the standing base 6 and a baseplate 14 of the vertical housing 1 of the gaming machine 32.

In order to close the vertical housing 1, an upper front flap 16 and a lower front flap 17 are provided, said front flaps being coupled so as to be pivotable in an opposed manner via corresponding hinges in the vertical housing 1 directly below the head part 2 and directly above the baseplate 14. Furthermore, respective damping elements 18 which facilitate pivoting of the front flap 16, 17 and ensure that same is held in an open position extend between the side walls 4 of the vertical housing 1 and the upper front flap 16 and the lower front flap 17.

The upper front flap 16 accommodates two screens 19 which are arranged one above the other, serve for depicting game contents and/or other visually perceptible contents and are connected to the game sequence controller 9. The screens 19 can be configured as desired, in particular as TFT, and/or LED and/or OLED and/or plasma displays or the like. In the closed state of the vertical housing 1, i.e. when the upper front flap 16 and the lower front flap 17 are folded in and lie between the frames 5, the edge of the lower front flap 17 overlaps a free lower portion 20 of the upper front flap 16, and a locking mechanism is effective, the locking mechanism comprising a locking part 22 which is inserted into a console 21 in the lower front flap 17, interacts with mating locking parts 23 in the opposite side walls 4 of the vertical housing 1 and is connected to a lock 24.

The console 21 is located on an upper edge of the closed lower front flap 17 and protrudes over the front thereof in such a manner that a user can place his hands thereon. Approximately centrally in the console 21 are a plurality of operating elements 26 which are designed as pushbutton switches 25 and are equipped with illuminating elements (not illustrated). In order to control the operating elements and/or illuminating elements and for data and signal exchange, the game sequence controller 9 comprises a control device which is connected to a master which communicates in real time via a two-wire connection 27 with the operating elements 26, which are designed as slaves, and/or illuminating elements. Accommodated in the console 21 to the sides of the operating elements 26 on one side is a money output shell 28 which, in the closed state of the lower front flap 17, is operatively connected to the money processing unit 10 via slots 29 for coins, and on the other side is a bill input/bill output shell 30 which has a bill slot and, in the closed state of the lower front flap 17, is connected to a bill processing unit 31 accommodated in the vertical housing 1, wherein the bill processing unit 31 comprises, for example, a bill box and/or a dispenser and is connected to the game sequence controller 9.

By means of the front flaps 16, 17 which are arranged so as to be pivotable in an opposed manner, the vertical housing 1 can be speedily opened and installation or repair of the gaming machine or servicing of the gaming machine or the components thereof, in particular the bill processing unit 31 and/or the money processing unit 10 for coin money or the associated boxes and/or dispensers for coins or bills, is relatively simple to implement.

The coin box 11 comprises a housing 34 which is substantially in the shape of a rectangular parallelepiped and is composed of two side walls 35, which are arranged in parallel and are spaced apart from each other, a rear wall 36, a cover 37 and a base 40 opposite the cover 37. On the front side, the cover 37 extends into a front panel 38 which extends over a partial region of the front side 39 of the housing 34, wherein a removal opening 41 running over the entire width of the housing 34 adjoins the front panel 38 in the direction of the base 40. A lower edge 42 of the removal opening 41 is formed by a foot panel 43 which emerges at a right angle from the base 40 and lies in a plane with the front panel 38.

The cover 37 contains a filling opening 63 which is in an operative relationship with the coin acceptor unit located therebelow in the gaming machine so that coins pass through the coin insertion slot 12 into the coin box 11 via the coin acceptor unit. In order to see the filling level of the coins within the housing 34, the front panel has a plurality of openings which are arranged offset with respect to one another and above one another, are designed as holes 46 and the size of which is smaller than the smallest coin to be received in the coin box 11. Furthermore, a clearance 44 extending to the front side 39 of the housing 34 is formed on the cover side, said clearance 44 being dimensioned for a hand to reach therethrough and being part of an integral handle piece 45 which is manufactured substantially by deforming the metal plate from which the housing 34 is composed.

From the lower edge of the removal opening 41, a supporting floor 48 running obliquely in the direction of the cover 37 extends over the entire width of the housing 34 as far as the rear wall 35, on which said supporting floor is held by means of a tab 62. Owing to the oblique plane formed by the supporting floor 48 within the housing 34, the coins present in the housing 34 slip to the removal opening 41 and pass through the latter into the open.

To open and close the removal opening 41, a sliding door 47 is arranged on the front side 39, said sliding door 47 being delimited in the upper end position thereof opening up the removal opening 41 and in the lower end position thereof closing the removal opening by means of corresponding stops 49. The sliding door 47 has, on the upper side, a handle piece 50 which is formed by repeated bending away at a free upper edge 51. The free lower edge 52 of the sliding door 47 has a double-layered reverse bend 61. The handle piece 50 and the reverse bend 61 stabilize the sliding door 47 over the width thereof. For the displaceable mounting of the sliding door 47, each side wall 35 has, on the front side, a bent portion 53 which extends over the entire height of the side wall, emerges outward perpendicularly from the side wall 35 and springs back, forming a clearance 54, in a portion 55 running parallel to the side wall 35. Multiply bent flanges 56 are provided on the opposite longitudinal sides of the sliding door 47, said flanges 56 engaging over the bent portions 55 of the side walls 35 and in the clearances 54 present between the portions 55 and the associated side walls 35. In addition to the guiding function, the flanges 56 which run over the entire height of the sliding door 47 also bring about a corresponding stabilization against deflection.

In order to secure the sliding door 47 in the end position closing the removal opening 41, a lock 57 to be actuated with a key is accommodated in a side wall 35, the lock 57 interacting with an associated locking bolt 58 which is guided in the base region, extends through the foot panel 43 and lies with the free end 59 thereof in a corresponding recess 60 of the sliding door 47 in order to lock the sliding door 47 in the lower end position thereof closing the removal opening 41.

LIST OF REFERENCE NUMBERS

1. Vertical housing
2. Head part
3. Frame part
4. Side wall
5. Frame
6. Standing foot
7. Cover panel
8. Rear wall

9. Game sequence
10. Money processing
11. Coin box
12. Coin insertion slot Return button
14. Baseplate
15. Foot rest
16. Upper front flap
17. Lower front flap
18. Damping element
19. Screen
20. Portion of 16
21. Console
22. Locking part
23. Mating locking part
24. Lock
25. Pushbutton switch
26. Operating element
27. Two-wire connection
28. Money output shell
29. Slot
30. Bill input/bill output shell
31. Bill processing unit
32. Gaming machine
33. Machine housing
34. Housing of 11
35. Side wall of 34
36. Rear wall of 34 controller
37. Cover of 34 unit
38. Front panel
39. Front side
40. Base
41. Removal opening
42. Lower edge of 41
43. Foot panel
44. Clearance
45. Handle piece
46. Hole
47. Sliding door
48. Supporting floor
49. Stop
50. Handle piece
51. Upper edge
52. Lower edge
53. Bent portion
54. Clearance
55. Portion
56. Flange
57. Lock
58. Locking bolt
59. End of 58
60. Recess
61. Reverse bend
62. Tab
63. Filling opening

The invention claimed is:

1. A coin box for a coin-operated device, wherein the coin box comprises a housing with a front-side removal opening, the removal opening is assigned a sliding door and a supporting floor for the coins is arranged in an interior of the housing, wherein the supporting floor is inclined from a rear wall of the housing in a direction of the removal opening, wherein the sliding door is mounted on a front side of the housing extending between opposite side walls and, in order to guide the sliding door, a bent portion extending parallel to and spaced apart from an associated side wall is formed on front edges of both side walls, wherein the sliding door has, on both sides, a multiple bend flange which wraps around and slidingly engages the bent portion and extends into a clearance present between the bent portion and the side wall.

2. The coin box as claimed in claim 1, wherein the sliding door, for locking in a position thereof closing the removal opening, is assigned a lock to be actuated with a key.

3. The coin box as claimed in claim 2, wherein the housing comprises a base which leads on a front side into a foot panel which forms a lower edge of the removal opening and is arranged parallel to the front panel and wherein the lock is arranged in a side wall of the housing, and a locking bolt which is assigned to the lock extends through the foot panel and lies in a recess of the sliding door in order to lock the sliding door in the position closing the removal opening.

4. The coin box as claimed in claim 1, wherein the housing is manufactured from a steel plate and is configured in a shape of a rectangular parallelepiped, wherein the removal opening is formed on the front side of the housing in a floor region thereof and has a front panel which is arranged above the removal opening and has a plurality of spaced-apart holes which are arranged next to one another and/or above one another.

5. The coin box as claimed in claim 1, wherein the sliding door has, on an upper side, a handle piece, which is formed, by deformation, on a free upper edge, and a free lower edge of said sliding door has a double-layered reverse bend.

6. The coin box as claimed in claim 1, wherein the removal opening is formed on the front side of the housing in a floor region thereof and has a front panel which is arranged above the removal opening and wherein the housing comprises a base which leads on a front side into a foot panel which forms a lower edge of the removal opening and is arranged parallel to the front panel and so as to be able to be overlapped by the sliding door in a closed state, wherein the supporting floor which extends toward the rear wall in a direction of a cover and runs over an entire width of the housing emerges from the foot panel and is held on a tab assigned to the rear wall.

7. The coin box as claimed in claim 1, wherein a filling opening and a clearance extending to the front side of the housing are formed in a cover, wherein the clearance is dimensioned for a hand to reach there through and is part of an integral handle piece.

8. The coin box as claimed in claim 1, wherein holders are provided for a money bag.

9. A gaming machine with a device housing in which the coin box as claimed in claim 1 is accommodated.

10. The gaming machine as claimed in claim 9, wherein the coin box is installed removably in the device housing.

11. The gaming machine as claimed in claim 9, wherein the coin box is arranged downstream of a coin acceptor unit which is connected via a coin channel to a housing-side coin insertion slot which is assigned to a frame of the device housing.

12. The gaming machine as claimed in claim 9, wherein the device housing is closable on a front side thereof with an upper front flap and a lower front flap which are arranged so as to be pivotable in an opposed manner on the device housing.

13. The gaming machine as claimed in claim 12, wherein the upper front flap has at least one display device, for depicting a game sequence, and/or the lower front flap has a console with operating elements for controlling a game sequence, wherein the display device, the operating elements and/or a money processing device are connected to a game sequence controller.

14. A coin box for a coin-operated device, wherein the coin box comprises a housing with a front-side removal opening, the removal opening is assigned a sliding door and a supporting floor for the coins is arranged in an interior of the housing, wherein the supporting floor is inclined from a rear wall of the housing in a direction of the removal opening;

wherein the housing comprises a base which leads on a front side into a foot panel which forms a lower edge of the removal opening;

wherein the sliding door, for locking in a position thereof closing the removal opening, is assigned a lock to be actuated with a key;

wherein the lock is arranged in a side wall of the housing, and a locking bolt which is assigned to the lock extends through the foot panel and lies in a recess of the sliding door in order to lock the sliding door in the position closing the removal opening.

15. A coin box for a coin-operated device, wherein the coin box comprises a housing with a front-side removal opening, the removal opening is assigned a sliding door and a supporting floor for the coins is arranged in an interior of the housing, wherein the supporting floor is inclined from a rear wall of the housing in a direction of the removal opening;

wherein a filling opening and a clearance extending to a front side of the housing are formed in a cover, wherein the clearance is dimensioned for a hand to reach there through and is part of an integral handle piece.

* * * * *